US005713467A

United States Patent [19]

Kao

[11] Patent Number: 5,713,467

[45] Date of Patent: Feb. 3, 1998

[54] TOOL DISPLAY PACK HAVING A SECURITY DEVICE

[76] Inventor: Jui-Chien Kao, No. 358, Tunghsing Rd., Shuwang Li, Tali City, Taichung Hsien, Taiwan

[21] Appl. No.: 797,790

[22] Filed: Feb. 7, 1997

[51] Int. Cl.[6] ..... B65D 75/56

[52] U.S. Cl. ..... 206/349; 206/377; 206/471; 206/481; 206/806; 211/70.6

[58] Field of Search ..... 206/349, 372, 206/376, 377, 461, 462, 464, 465, 470, 471, 477, 481–483, 806, 807; 211/60.1, 70.6

[56] References Cited

U.S. PATENT DOCUMENTS

| | | | |
|---|---|---|---|
| 4,069,915 | 1/1978 | Schurman | 206/349 |
| 4,378,068 | 3/1983 | Bell | 206/806 |
| 4,634,005 | 1/1987 | Kulzer et al. | 206/349 |
| 4,650,074 | 3/1987 | Vosbikian | 206/349 |
| 4,711,352 | 12/1987 | Williams et al. | 206/481 |
| 4,729,473 | 3/1988 | Kulzer et al. | 206/481 |
| 5,234,106 | 8/1993 | Transue et al. | 206/349 |

*Primary Examiner*—Paul T. Sewell
*Assistant Examiner*—Luan K. Bui
*Attorney, Agent, or Firm*—Kirkpatrick & Lockhart LLP

[57] ABSTRACT

A tool display pack having a security device includes a body and a catch member which has one end thereof pivotally connected to the body which has a first hole defined in a top thereof and a second hole and a slot respectively defined in one side thereof. The catch member has a hook member extending laterally from the other end thereof and a third hole defined beside the hook which is engagement with the slot when the catch member is in a closed position such that a tool can be supported by the catch member. A lock pin has a head and a shank extending from the head, the shank having a flange extending radially from a free end thereof so that the lock pin extends through the third hole and the second hole when the flange is compressed and the flange has a diameter not less than that of the second hole.

5 Claims, 4 Drawing Sheets

TOOL DISPLAY PACK HAVING A SECURITY DEVICE

BACKGROUND OF THE INVENTION

1. Field of the Invention

The present invention relates to a display pack and, more particularly, to an improved tool display pack which has a catch member pivotally connected thereto and a lock pin extending through a free end of the catch member and a body of the pack so that the catch member cannot be pulled from the body unless the lock pin is cut.

2. Brief Description of the Prior Art

Hardware stores uses a display packs to display tools on walls and these tool display packs each have a simple structure and can be hung on the hook. Generally, a tool is supported on a catch member pivotally connected to the body of the tool display pack so that customers can see the whole configuration of the tool. An inherent shortcoming of the tool display pack is that the display pack is easily broken simply by pulling the catch member away from the rack. Therefore, a thief can remove the tool and conceal it about his person.

The present invention intends to provide an improved tool display pack which has a security device so that the catch member is not detachable except by cutting a lock pin extending through the body and the catch member so as to mitigate and/or obviate the above-mentioned problems.

SUMMARY OF THE INVENTION

The present invention provides a tool display pack comprising a body and a catch member pivotally connected to the body with a lock pin extending through the catch member and the body. The body has a first hole defined in a top thereof and a slot defined through a lower end near one of two sides thereof, a second hole defined through the body and located beside the slot.

The catch member has a hook extending laterally from a free end thereof for engagement with a periphery defining the slot. A third hole is defined through the free end of the catch member and is located beside the hook.

The lock pin has a head and a shank extending from the head, a slit defined longitudinally in the shank and a flange extending radially from a free end of the shank such that the lock pin is compressed, it extends through the third hole of the catch member and the second hole of the body, and returns to its non-compressed state to secure the catch member to the body.

It is an object of the present invention to provide a tool display pack which has a catch member disposed thereto and a lock pin extends through the catch member and a body so that the catch member cannot be opened from the body unless the lock pin is cut.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
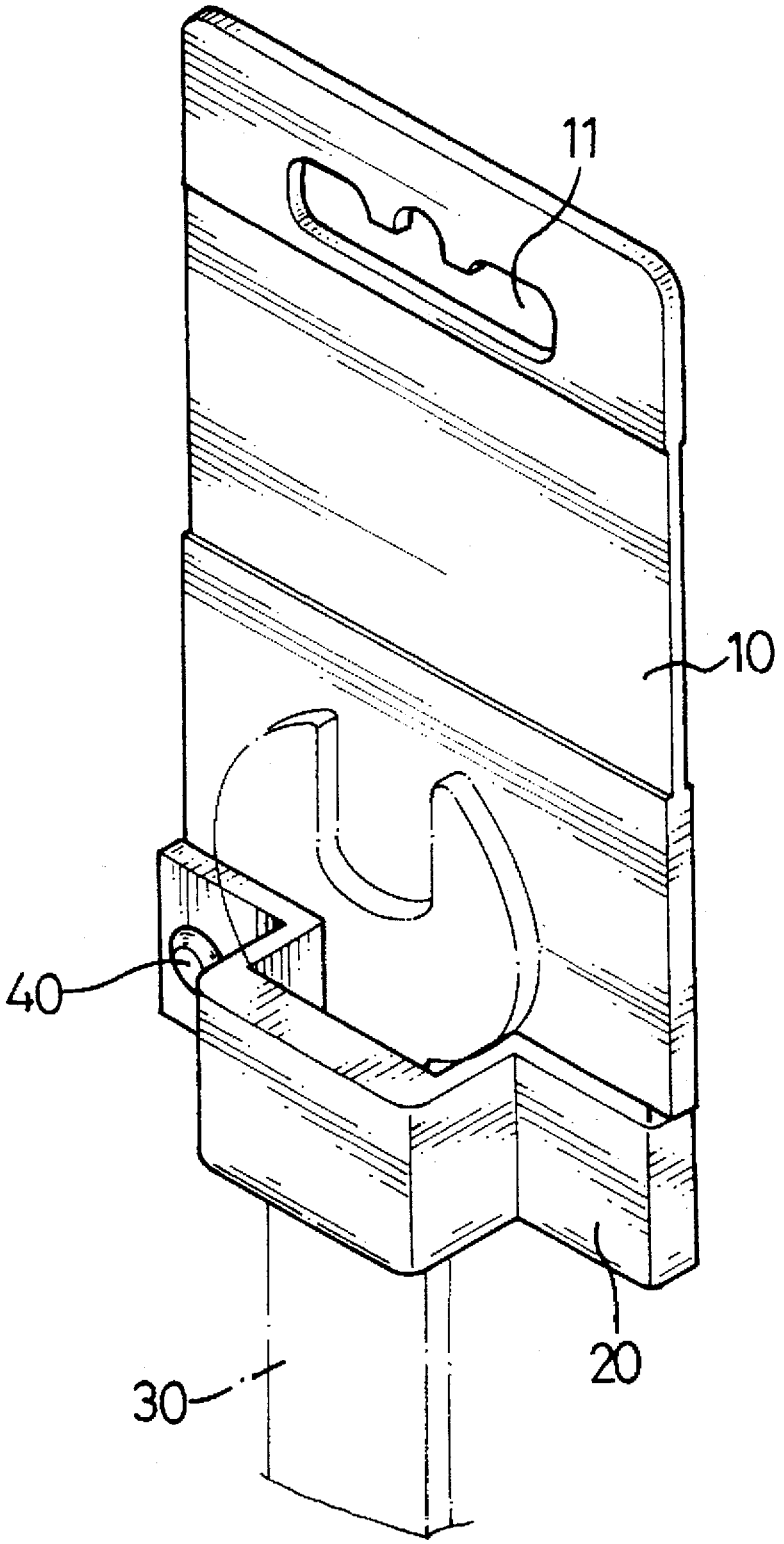
FIG. 1 is a perspective view of a tool display pack in accordance with the present invention wherein a spanner (shown in phantom lines) is supported by a catch member.
Figure 2:
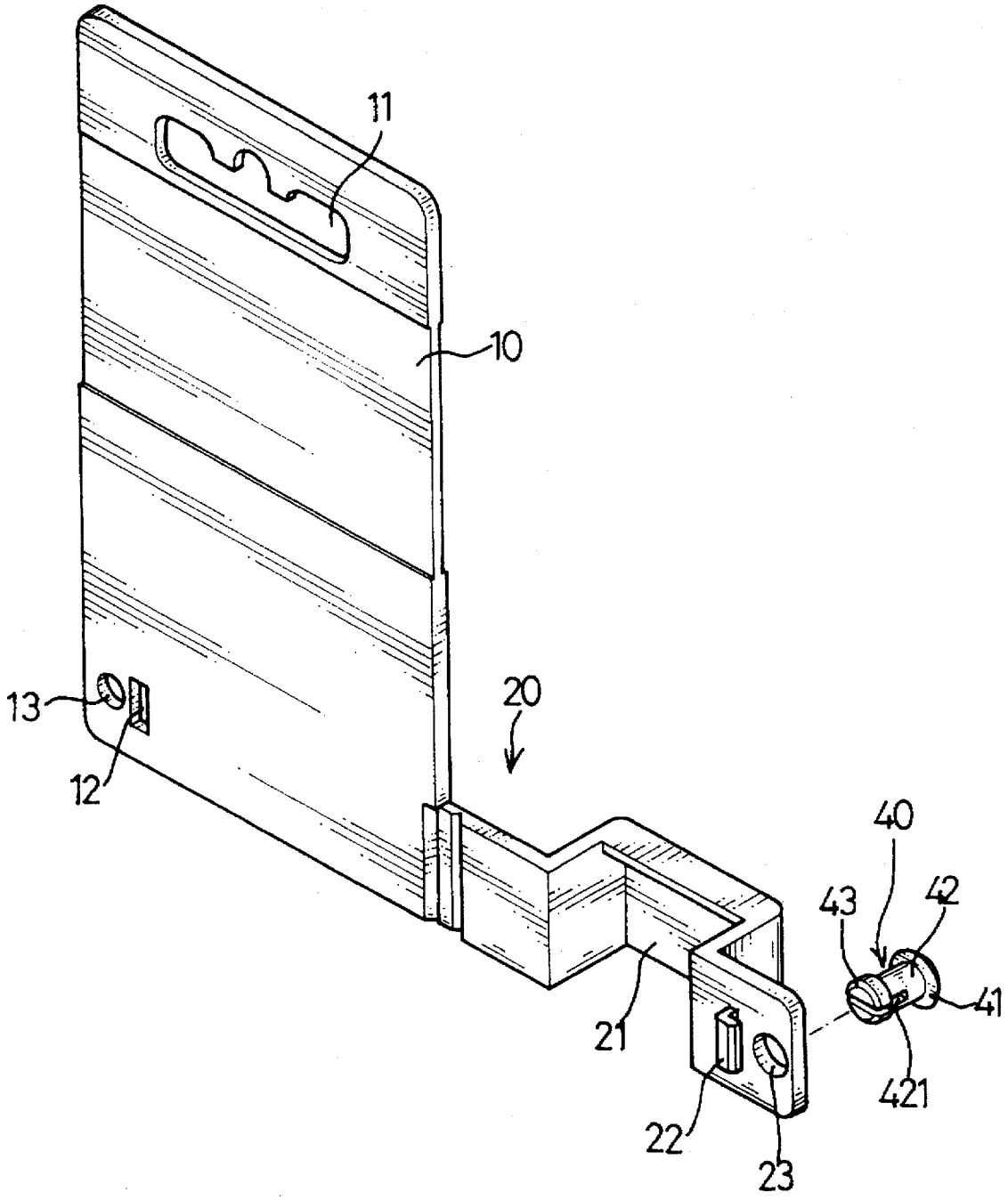
FIG. 2 is an exploded view of the tool display pack in accordance with the present invention.
Figure 3:
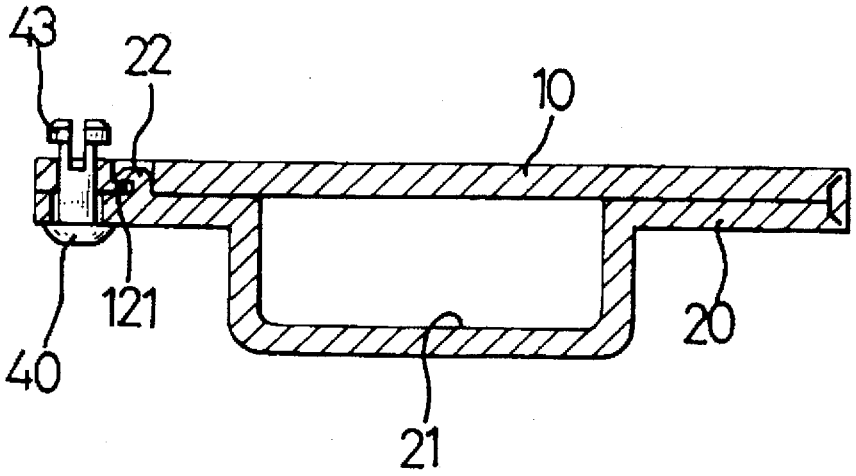
FIG. 3 is an end elevational view, partly in section, of the tool display pack when the catch member is in a closed position.

Referring to the drawings and initially to FIGS. 1 through 3, a tool display pack in accordance with the present invention generally includes a body 10 which has a first hole 11 defined in a top thereof so that the body 10 can be hung on a hook (not shown) and a slot 12 defined through a lower end near one of two sides thereof. A protrusion 121 extends laterally from a periphery defining the slot 12. A second hole 13 is defined through the body 10 and is located beside the slot 12.

A catch member 20 has one end thereof integrally and pivotally connected to the of the two other side of the body 10 and has a recessed portion 21 defined in an inner side thereof so as to define a space between the catch member 20 and the body 10. A hook 22 extends laterally from a free end of the catch member 10 so as to be engaged with the protrusion 121 extending from the periphery defining the slot 12 when the catch member 20 is in a closed position. A third hole 23 is defined through the free end of the catch member 20 and is located beside the catch member 22 wherein the third hole 23 has a diameter larger than that of the second hole 13 in the body 10. Accordingly, a spanner 30 (for example, shown in phantom lines) can be supported by the periphery defining the recessed portion 21 of the catch member 20.

Figure 4:
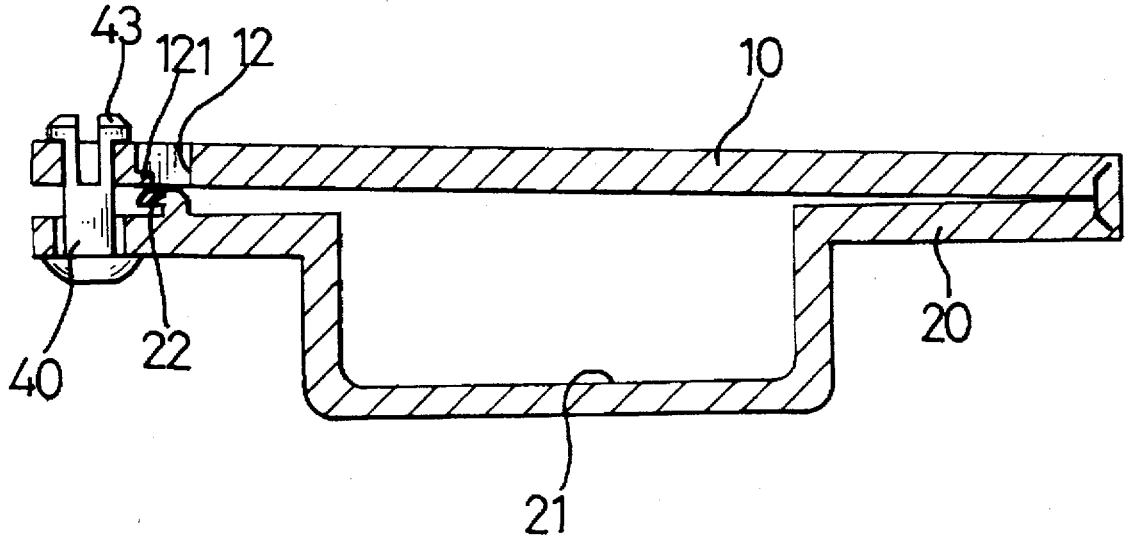
FIG. 4 is an end elevational view, partly in section, of the tool display pack when the catch member is pulled and is limited by the lock pin.

A security device comprises a lock pin 40 which has a head 41 and a shank 42 extending from the head 41, the shank 42 having a slit 421 defined longitudinally therein so as to form two resilient parts. A flange 43 extends radially from a free end of each the parts of the shank 42 and the flange 43 has a diameter not smaller than that of the second hole 13 in the body 10. Therefore, when the catch member 20 is in the closed position with the hook 22 received in the slot 12, the lock pin 40 extends through the third hole 23 and the second hole 13 after the two parts of the shank 42 have been pressed together. Because the diameter of the flange 43 is not smaller than that of the second hole 13, the flange 43 effectively limits the lock pin 40 from disengaging from the second hole 13 and the third hole 23 as shown in FIG. 4 such that the catch member 20 cannot be separated from the body 10 unless that the lock pin 40 is cut.

Accordingly, the tool display pack in accordance with the present invention has a simple structure and the lock pin 40 effectively prevents the catch member 20 from being disengaged from the body 10 arbitrarily.

Although the invention has been explained in relation to its preferred embodiment, it is to be understood that many other possible modifications and variations can be made without departing from the spirit and scope of the invention as hereinafter claimed.

What is claimed is:

1. A tool display pack comprising:

a body which has a first hole defined in a top thereof and a slot defined through a lower end near one of two sides thereof, a second hole defined through said body and located beside said slot;

a catch member having one end thereof pivotally connected to the other side of said body and having a hook extending laterally from a free end thereof for engagement with a periphery defining said slot, a third hole defined through said free end of said catch member beside said hook, said catch member having a recessed portion defined in an inner side thereof so as to define a space between said catch member and said body, and a lock pin having a head and a shank extending from said head and said shank sized to fit said third hole, a flange extending radially from a free end of said shank.

2. The tool display pack as claimed in claim 1 wherein said flange has a diameter not smaller than that of said second hole in said body.

3. The tool display pack as claimed in claim 1 wherein said third hole has a diameter larger than that of said second hole in said body.

4. The tool display pack as claimed in claim 1 wherein said shank has a slit defined longitudinally therein.

5. The tool display pack as claimed in claim 1 wherein said periphery defining said slot has a protrusion extending laterally therefrom so as to be engaged with said hook.

* * * * *